US007128811B2

(12) United States Patent
Watanabe

(10) Patent No.: US 7,128,811 B2
(45) Date of Patent: Oct. 31, 2006

(54) BELT FOR A PAPERMAKING MACHINE

(75) Inventor: Kazumasa Watanabe, Tokyo (JP)

(73) Assignee: Ichikawa Co., Ltd., Tokyo (JP)

( * ) Notice: Subject to any disclaimer, the term of this patent is extended or adjusted under 35 U.S.C. 154(b) by 532 days.

(21) Appl. No.: 10/643,357

(22) Filed: Aug. 19, 2003

(65) Prior Publication Data

US 2004/0040685 A1 Mar. 4, 2004

(30) Foreign Application Priority Data

Aug. 27, 2002 (JP) ..... 2002-247514

(51) Int. Cl.
*D21F 3/00* (2006.01)
*D21F 7/00* (2006.01)

(52) U.S. Cl. ..... 162/358.4; 162/901; 428/147; 428/307.3; 428/909; 442/101; 442/121; 442/148; 442/164

(58) Field of Classification Search ..... 162/358.2, 162/358.3, 358.4, 901, 204–207, 306; 100/118, 100/153; 156/462; 474/260–268; 442/101, 442/64–75, 118, 121, 148, 164; 428/143, 428/147, 307.3, 307.7, 323, 327, 909
See application file for complete search history.

(56) References Cited

U.S. PATENT DOCUMENTS 4,482,430 A 11/1984 Majaniemi
5,298,124 A * 3/1994 Eklund et al. ..... 162/306
5,965,208 A * 10/1999 Fagerholm et al. .... 427/428.21
6,036,819 A * 3/2000 Miller et al. ..... 162/358.2
6,325,897 B1 * 12/2001 Ishino et al. ..... 162/358.4
6,530,854 B1 * 3/2003 Sakuma et al. ..... 474/237
6,547,924 B1 * 4/2003 Klerelid et al. ..... 162/109
6,616,814 B1 * 9/2003 Best ..... 162/358.4
2005/0224318 A1 * 10/2005 Hikida ..... 198/844.1

FOREIGN PATENT DOCUMENTS

JP 6-81291 3/1994

* cited by examiner

*Primary Examiner*—Eric Hug
(74) *Attorney, Agent, or Firm*—Howson and Howson

(57) ABSTRACT

A belt for a papermaking machine has minute projections and recesses randomly formed in a shoe-contacting surface of the belt by a powdery material contained in a high molecular weight elastic section formed on a base body. The surface roughness RZ of the shoe-contacting surface is between 50 and 500 microns; the particle diameter of the powdery material is between 5 and 500 microns; and the content of the powdery material in the high molecular weight elastic section is between 5 and 50 percent by weight. A lubricant is held in the minute projections and recesses, and consequently more lubricant may be supplied between the belt and the shoe with which it cooperates. As a result, friction between the belt and the shoe is reduced, and less energy is required to drive the papermaking machine.

2 Claims, 5 Drawing Sheets

| FINE PARTICLES | SURFACE ROUGHNESS OF SHOE CONTACTING SURFACE (Rz) | LOAD OF MOTOR (AMPERE) | TOTAL EVALUATION |
|---|---|---|---|
| ACRYLIC RESIN (ORGANIC COMPOUND) | 30μ | 9A | △ |
| | 50μ | 8A | ○ |
| | 100μ | 6.5A | ◎ |
| | 200μ | 6.5A | ◎ |
| | 500μ | 8A | ○ |
| | 800μ | 10A | △ |

BELT FOR A PAPERMAKING MACHINE

FIELD OF THE INVENTION

This invention relates to belts for a papermaking machines, and more particularly to improvements in papermaking machine belts by which the cost of operation of a papermaking machine may be reduced.

BACKGROUND OF THE INVENTION

In a papermaking machine, it is now common to incorporate a shoe press. A shoe press comprises a press roll and a shoe opposed to the press role. A wet paper web is typically carried, between felts, through a nip formed between the shoe and the press roll. A shoe press apparatus has a larger nip area than a press comprising a pair of opposed press rolls.

In FIG. 1(*a*), which is a schematic view of a conventional shoe press apparatus 100*a,* a relatively long shoe press belt B is used. In the shoe press apparatus 100*b,* of FIG. 1(*b*), a relatively short shoe press belt is used. Each of these shoe presses has a press part P, comprising a press roll R and a shoe S. A wet paper web W, disposed between a pair of felts F, passes, along with the belt B, through the press part P as the press roll R rotates in the machine direction, depicted by arrow MD.

FIG. 2 is a schematic view of a conventional shoe press 100*c,* used in the calender part of a papermaking machine. A calender belt BC and a rough paper web W' are sandwiched in the press part P between a calender roll R' and a shoe S as the calender roll R' rotates.

The belts B and BC are used in different parts of the papermaking machine and their structures are different in detail, in order to achieve the desired effects. However, their basic structure is the same, in that they both comprise a base body for imparting strength to the belt, and a high molecular weight elastic section, which formed on the base body. The high molecular weight elastic section prevents liquid from passing from one surface of the belt to the opposite surface.

A lubricant, which in many cases is oil, is usually supplied to the shoe press apparatus to reduce friction between the shoe and the belt. Reduction of the friction between the shoe and the belt reduces the energy required in order for the press roll to drive the belt.

A problem in the operation of a conventional shoe press apparatus arises because the lubricant is present in a thin layer. The thin layer of lubricant does not have an adequate friction-reducing effect, and therefore, the force required in order for the press roll to drive the belt is large. Friction in the operation of the belt under these conditions also produces heat, which causes the temperature of the lubricant to rise, and its coefficient of viscosity to decrease. The decrease in viscosity of the lubricant results in a still further increase in friction.

For the above reason, various kinds of machine structures have been devised to supply more lubricant between the shoe and the belt in a shoe press apparatus. In addition, various kinds of belt structures have been invented in order to supply more lubricant to the press part.

FIGS. 3(*a*), 3(*b*) and 3(*c*) show a system, disclosed in U.S. Pat. No. 4,482,430, for supplying lubricant to the press part of a shoe press apparatus. FIG. 3(*a*) shows a lubricant feeder L on the upstream side in the machine direction relative to a shoe S, for supplying a lubricant L1 between a shoe S and a shoe-contacting surface B12 of a belt B1. A plurality of recesses B13 are provided in the shoe-contacting surface B12 of the belt B1 for holding lubricant. As the belt B1 advances under nip pressure while lubricant is held in the recesses B13, lubricant is supplied between the shoe S and the belt B1.

Various examples of recesses are disclosed in U.S. Pat. No. 4,482,430. For example, cup-shaped recesses B13 are shown in FIG. 3(*b*), and a groove-shaped recesses B13' are shown in FIG. 3(*c*).

FIG. 4 shows a belt disclosed in unexamined Japanese Patent Publication 81291/1994. In this technology, a belt B2 comprises a base body formed by overlaying machine direction yarns B24 and cross machine direction yarns B25, and a high molecular weight elastic section provided on the base body. The belt B2 has a wet paper web-contacting surface B21 and a shoe-contacting surface B22.

Convex parts B23 are formed on the shoe-contacting surface B22 of the belt B2. These convex parts, in turn, provide recesses in the shoe contacting surface B22. This enables lubricant to be held in the shoe-contacting surface B22 of the belt B2, and supplied between the shoe and the belt B2.

Although the belts of FIGS. 3 and 4 have recesses in their shoe-contacting surfaces so that lubricant may be held therein, the supply of lubricant may still be insufficient since no lubricant is held on the surfaces of the convex parts which are in contact with the shoe. The object of the invention is to provide a belt for a papermaking machine which ensures a sufficient supply of lubricant between the belt and the shoe.

SUMMARY OF THE INVENTION

The papermaking machine belt in accordance with the invention has a wet paper web-contacting surface and a shoe-contacting surface, and comprises a base body and a high molecular weight elastic section forming at least the shoe-contacting surface. The high molecular weight elastic section contains a powdery material, which forms projections and recesses on the shoe-contacting surface.

Preferably, the surface roughness Rz of the shoe-contacting surface is between 50 and 500 microns, the particle diameter of the powdery material is between 5 and 500 microns, and the content of the powdery material in the high molecular weight elastic section is between 5 and 50 percent by weight.

The powdery material is preferably a metal powdery material, an inorganic compound powdery material, a resin powdery material or a combination of two or more such materials.

In the case where the powdery material is an inorganic compound, it is preferably a lipophilic inorganic compound. In the case where the powdery material is a resin, it preferably comprises an oil-absorbing resin or a lipophilic resin.

According to the invention, more lubricant is supplied between the belt and the shoe, since lubricant is held by the projections and recesses which are randomly formed in the shoe-contacting surface by the powdery material. As a result, friction between the belt and the shoe is reduced and less energy is required to drive the papermaking machinery.

BRIEF DESCRIPTION OF THE DRAWINGS

FIGS. 3(*b*) and 3(*c*) are fragmentary elevational views showing two alternative surface configurations for the belt in the apparatus of FIG. 3(*a*);

DETAILED DESCRIPTION OF THE PREFERRED EMBODIMENTS

Figure 1A:
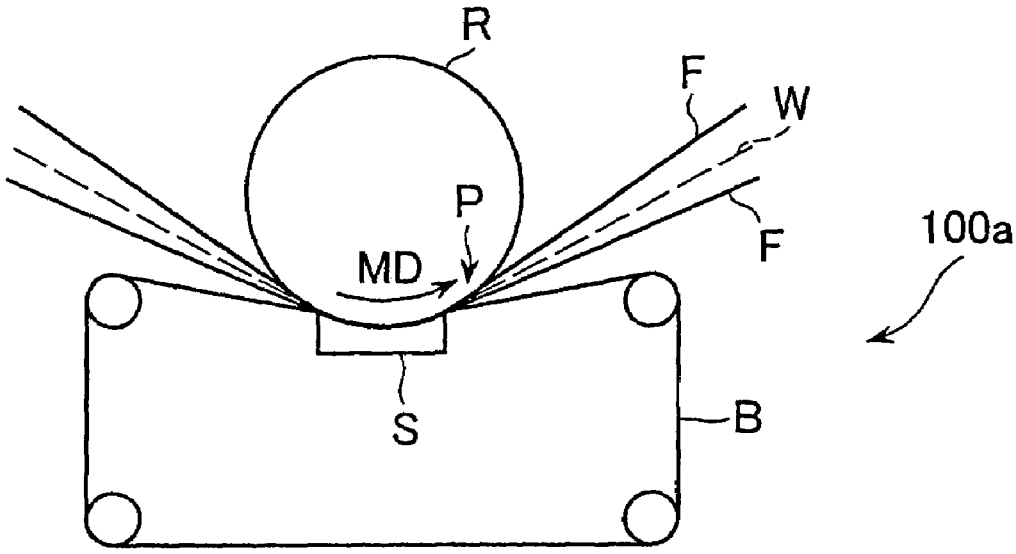
FIGS. 1(*a*) and 1(*b*) are schematic views of two conventional shoe presses.
Figure 1B:
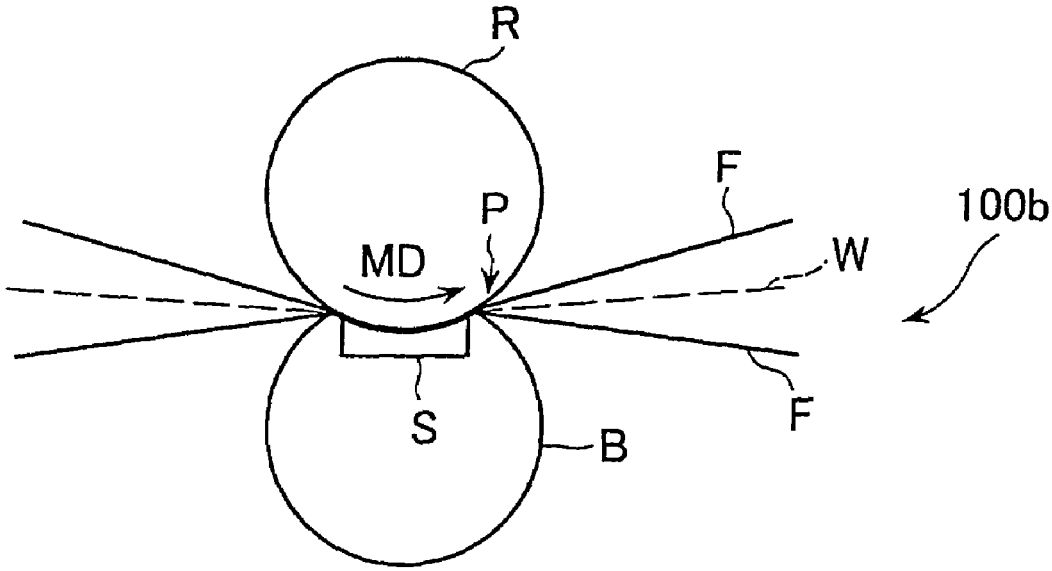
Figure 2:
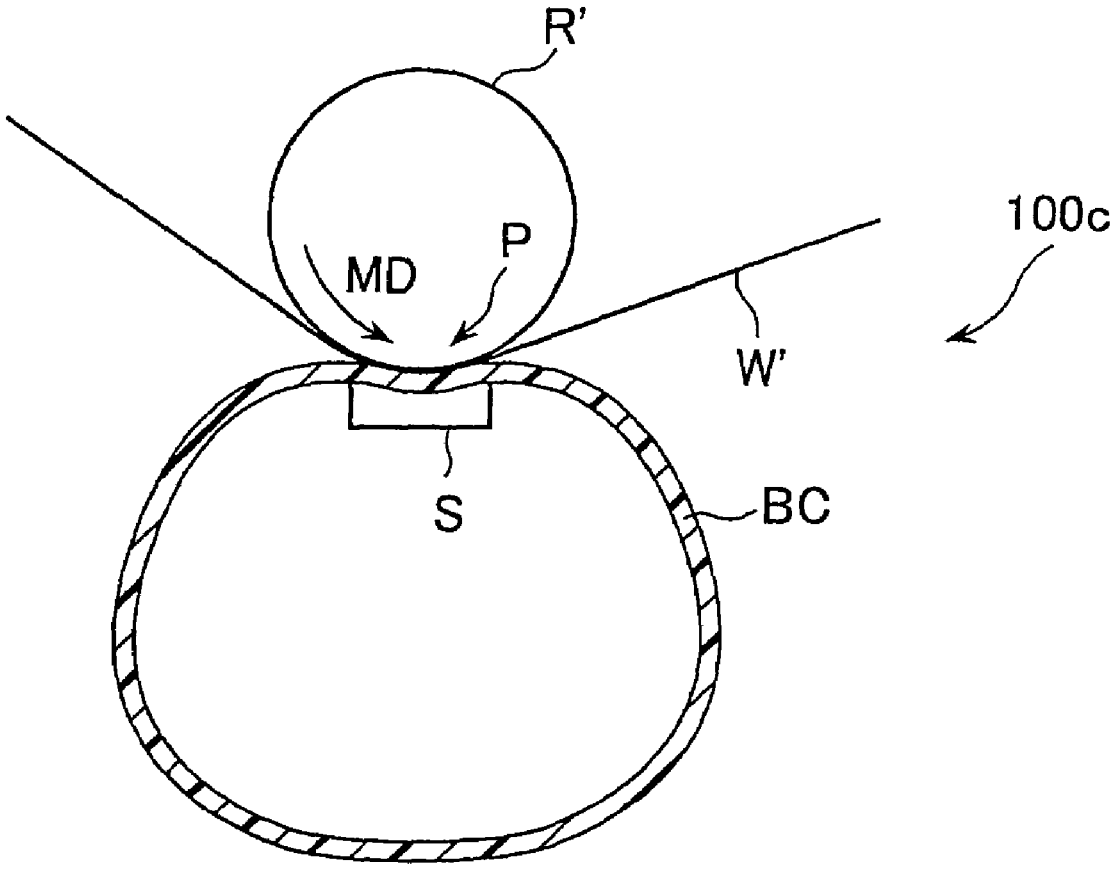
FIG. 2 is a schematic view of a conventional shoe press used in the calender part of a papermaking machine.
Figure 3A:
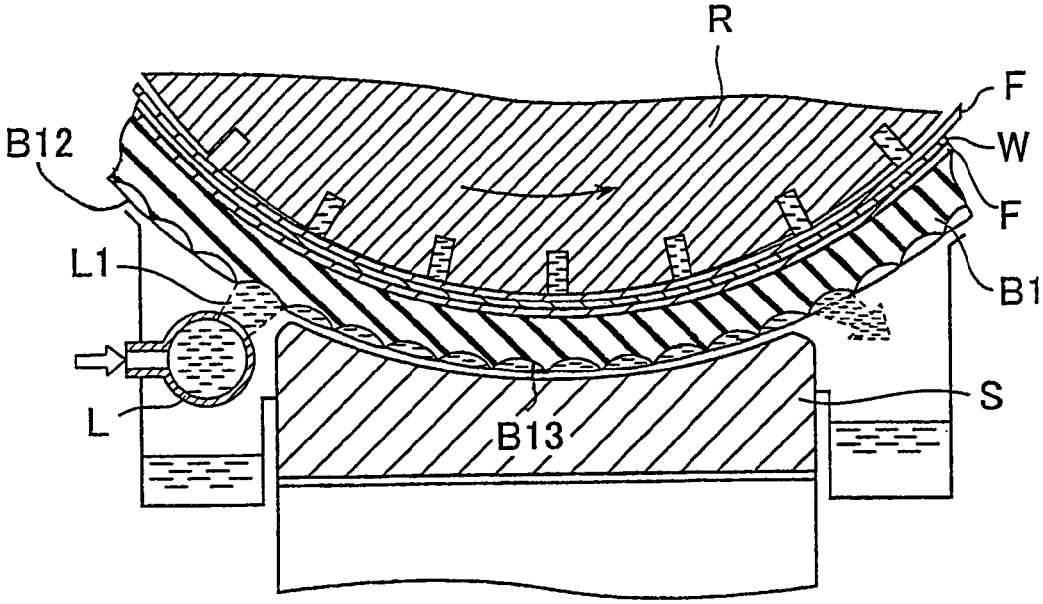
FIG. 3(*a*) is an schematic view of a prior art apparatus for supplying lubricant between a shoe and a belt.
Figure 3B:
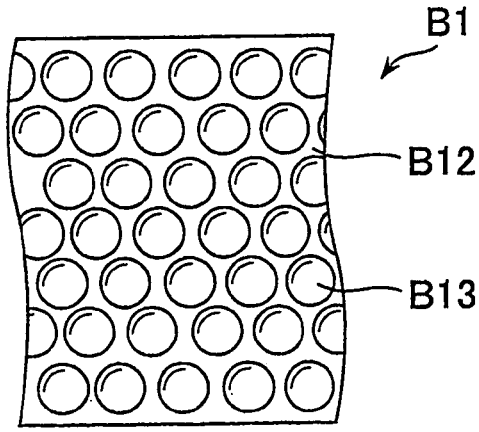
Figure 3C:
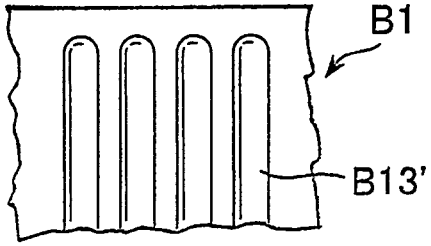
Figure 4:
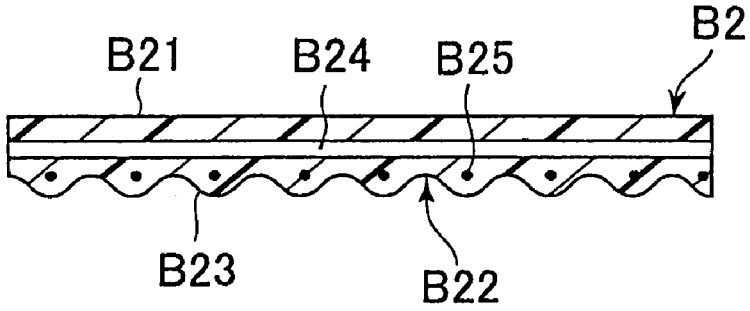
FIG. 4 is a cross-sectional view of a prior art shoe press belt for supplying lubricant between a shoe and a belt.
Figure 5:
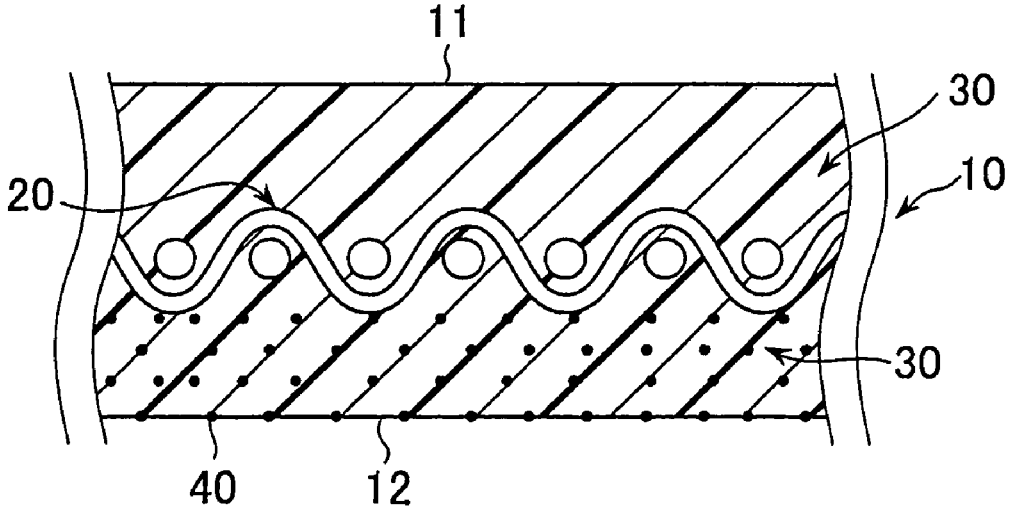
FIG. 5 is a cross-sectional view of a shoe press belt according to the invention.

An embodiment of a belt for a papermaking machine according to the invention will be explained with reference to FIG. 5, which shows a belt 10 comprising a base body 20, and a high molecular weight elastic section 30. The belt has a wet paper web-contacting surface 11, and a shoe-contacting surface 12. The base body 20 is provided to impart strength to the belt 10, and, as shown in FIG. 5, may comprise a woven base fabric having a machine direction yarns and cross machine direction yarns. However, the base body 20 is not limited to woven materials. For example, the base body may consist of machine direction yarns and a cross machine direction yarns that are overlaid rather than woven. The base body can also be composed of a narrow belt-shaped fabric wound in a spiral to form an endless fabric base.

A high molecular weight elastic section 30 is formed on both sides of the base body 20, and also in voids between the yarns of the base body. In addition, the shoe press belt may have a unique structure, such as one wherein grooves are provided in the wet paper web-contacting surface of a high molecular weight elastic section for temporarily holding water from the wet paper web, or one wherein a high molecular weight elastic section is not formed on the wet paper web contacting side of the belt, so that a surface of a base body forms a wet paper web-contacting surface of the belt. In any case, a belt according to the invention has a shoe-contacting surface 12 formed by a high molecular weight elastic section 30.

Minute projections and recesses are randomly formed in the shoe-contacting surface 12 by powdery material 40 contained in a high molecular weight elastic section 30. The size of the powdery material 40 is in the order of 50 microns, and therefore exaggerated in FIG. 5 for the purpose of illustration. The invention supplies more lubricant between a shoe and the belt 10, since lubricant is held by the minute projections and recesses formed by the powdery material 40. A belt having superior effects may be manufactured easily, since the high molecular weight elastic section 30 is formed simply by mixing the powdery material 40 with high molecular weight elastic material, applying the mixture to a base body 20, and curing it.

As a result of experiments, it was determined that the most suitable roughness Rz for the shoe-contacting surface 12 is between 50 and 500 microns. The surface roughness Rz is based on a ten-point average roughness measuring method defined in JISB0601.

It is desirable to use fine particles having an average particle diameter in the range from 5 to 500 microns, preferably 100 to 300 microns, so that a surface roughness in the above range may be achieved. In addition, the average particle diameter of the powdery material 40 is a median size (median diameter) in an asymmetric particle diameter distribution curve which will be generally recognized by those skilled in the art.

It is desirable to mix the powdery material 40 into a high molecular weight elastic material at a concentration between 5 and 50 percent by weight, preferably, between 10 and 20 percent by weight.

In this connection, fine metal powdery material, inorganic compound powdery material, and resin powdery material may be used as the powdery material 40. Either one kind, or a mixture comprising a plurality of kinds of the above materials, may be used.

A lipophilic inorganic compound such as talc may be used as an inorganic compound powdery material. In this case, lubricant is not only held in minute projections and recesses of a shoe-contacting surface 12, but, the lipophilic chemical characteristics of talc enable the lubricant to be adsorbed in the shoe-contacting surface 12. In addition, a lipophilic inorganic compound exhibits little frictional resistance, and is convenient for implementation of the invention.

In the case of a powdery resin material, spherical or hollow powder particles, oil-absorbing powdery resin material such as polymer gel, etc., or lipophilic resin such as acrylic resin and polystyrene resin, may be used as the powdery resin material. Increased amounts of lubricant may be held in a shoe-contacting surface 12 of a belt 10 due to the effects of powdery resin material.

Figures 6, 7:
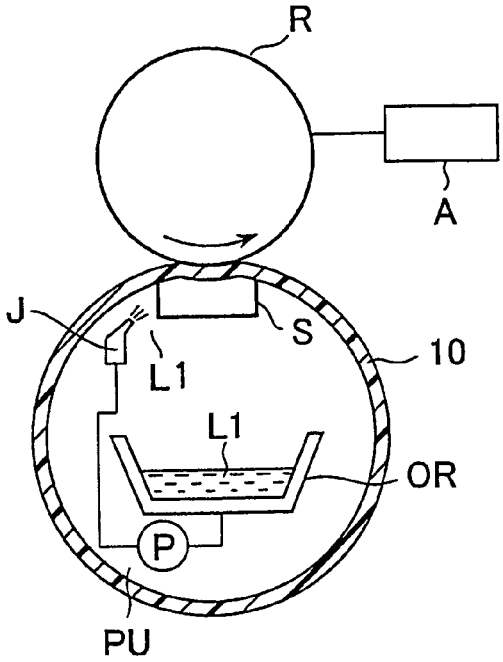
FIG. 6 is a schematic view of an apparatus for testing performance of a belt for a papermaking machine.
FIG. 7 is a tabulation of results of tests conducted using the apparatus of FIG. 6.

Tests were conducted using an apparatus shown in FIG. 6 to determine the effects of belts according to the invention. First, samples were prepared as Examples. Structures common to all samples were manufactured in the following steps.

First, machine direction yarns and cross machine direction yarns were woven, and an endless woven fabric was prepared as a base body. A polyester monofilament was used for both the machine direction yarn material and the cross machine direction yarn material. The peripheral length of the endless woven fabric was 6 m, and its width was 0.2 m. The base body was supported between two rollers at a predetermined tension, and driven by rotation of the rollers.

Next, Adiprene L167, (a trademark of Uniroyal Chemical Company was prepared as a prepolymer, and Cuamine MT (a trade mark of Ihara Chemical Industry Co., Ltd.) was prepared as a hardener. The prepolymer and hardener were mixed to produce a thermosetting liquid urethane.

A powdery material comprising acrylic resin, which is an organic compound, was mixed into the liquid urethane. The grain diameter of the fine particles, and the amount of the mixture, were adjusted so that desired surface roughness was obtained. The liquid urethane containing the powdery material was impregnated into the woven fabric so that it saturated the interior and the upper part of the woven fabric, and formed a layer on the upper surface of the woven fabric. The liquid urethane was then cured.

The base body was then removed from the rollers and turned inside-out, so that the urethane section containing the powdery material forms the inner surface of a belt. The base body with the powder-containing inner urethane layer was then returned to the rollers.

Additional liquid urethane, similar to the liquid urethane prepared previously, but without the powdery material, was than applied to the upper surface of the base body. This added liquid urethane adhered to the already cured urethane in the interior of the base body. The liquid urethane formed a layer on the outer part of the base body and was cured.

Finally, the outer surface of the urethane section was ground, and a sample, having a thickness of 4.5 mm, was obtained.

The sample was sandwiched by a press roll R and a shoe S in the testing apparatus shown in FIG. 6, and experiments were conducted. The sample was driven by rotation of the press roll R. An ammeter A was provided to measure the load on a motor (not shown) driving the press roll R. An oil injection apparatus J projected a jet of oil L1 between the shoe and the inner side of the sample. In addition, the oil L1 which fell off the inner side of the sample was collected in an oil receiver OR. The oil in this oil receiver OR recirculated to the oil injection apparatus J by a pump PU.

The operating conditions of the testing apparatus were as follows. The speed of the sample was 15 m/min. The tension in the sample was 50 KN/m. The applied pressure was 300 KN/m2. The rate of flow of oil form the oil injection apparatus was 1 L/min.

The results of the experiments are shown in FIG. 7. In the total evaluation column, the symbol ◎ signifies highly superior performance, the symbol ○ signifies superior performance, and the symbol Δ signifies performance comparable to that of prior art shoe press belts. It was determined that superior effects were obtained when surface roughness Rz was in the range from 50 and 500 microns, and that optimum results were obtained when the surface roughness Rz was in the range from 10 to 100 microns. As will be seen from the table, the load on the motor increased significantly when the surface roughness Rz was either excessively small or excessively large.

With a belt in accordance with the invention, a larger quantity of lubricant may be supplied between a belt and a shoe since lubricant is held by the projections and recesses which are randomly formed in the shoe-contacting surface of the belt by the powdery material contained in the high molecular weight elastic layer. As a result, friction between the belt and the shoe is reduced, and significantly less energy is required to drive the papermaking machine.

What is claimed is:

1. A belt for a papermaking machine having a wet paper web-contacting surface, and a shoe-contacting surface, said belt comprising a base body and a high molecular weight elastic section forming at least said shoe-contacting surface, said high molecular weight elastic section containing a powdery material, and the powdery material forming projections and recesses on the shoe-contacting surface, wherein said powdery material comprises a lipophilic inorganic compound.

2. A belt for a papermaking machine having a wet gaper web-contacting surface, and a shoe-contacting surface, said belt comprising a base body and a high molecular weight elastic section forming at least said shoe-contacting surface, said high molecular weight elastic section containing a powdery material, and the powdery material forming projections and recesses on the shoe-contacting surface, wherein said powdery material comprises an oil-absorbing resin or lipophilic resin.

* * * * *